United States Patent [19]

Omholt

[11] 4,236,362

[45] Dec. 2, 1980

[54] WALL SYSTEM

[76] Inventor: Ray E. Omholt, c/o American Sportsurfacing Co., Inc. Strafford Office Bldg. No. 2 Suite 218, Wayne, Pa. 19087

[21] Appl. No.: 938,295

[22] Filed: Aug. 31, 1978

[51] Int. Cl.[3] ..... E04B 5/52; A63J 3/00

[52] U.S. Cl. ..... 52/228; 52/488; 52/291; 272/3

[58] Field of Search ..... 52/227–229, 52/222, 223 R, 231, 291, 483, 490, 281, 282, 827, 828, 488; 273/95 H; 272/3

[56] References Cited

U.S. PATENT DOCUMENTS

| | | | |
|---|---|---|---|
| 1,768,624 | 7/1930 | McGuire | 52/488 |
| 2,049,278 | 7/1936 | Toussaint | 52/488 |
| 2,986,782 | 6/1961 | Elmendorf | 52/483 |
| 3,270,472 | 9/1966 | Gilbert | 52/348 |
| 3,418,776 | 12/1968 | Manderbach | 52/488 |
| 3,826,055 | 7/1974 | Bobzin | 52/483 |
| 4,041,667 | 8/1977 | Lindner | 52/483 |
| 4,070,805 | 1/1978 | Kastner | 52/282 |

*Primary Examiner*—John E. Murtagh
*Assistant Examiner*—H. E. Raduazo
*Attorney, Agent, or Firm*—Seidel, Gonda, Goldhammer & Panitch

[57] ABSTRACT

A wall system comprised of panels made of material dimensionally reactive to moisture content changes such as may be used for the sports of racquetball or squash in which panels are joined to vertical support members and to horizontal steel stress straps so as to control shrinkage and expansion forces within the panels due to changes in moisture content of the panels.

12 Claims, 4 Drawing Figures

FIG. 1
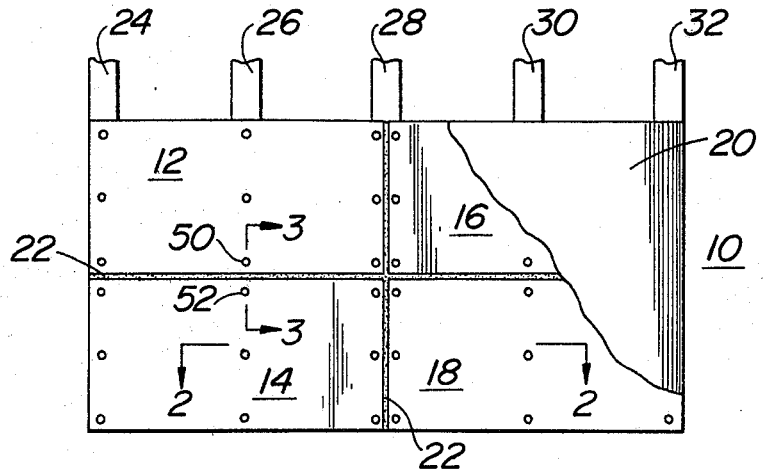
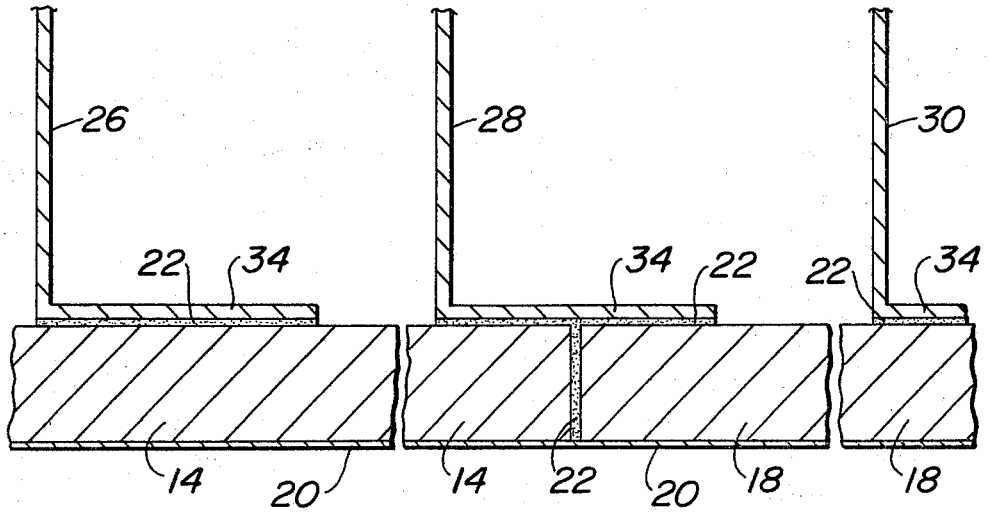
FIG. 2

WALL SYSTEM

BACKGROUND

This invention relates to wall systems particularly intended for use in sports courts for sports such as racquetball and squash. The wall systems according to this invention may also be used in any other application where dimensional stability as a function of moisture changes is important. Other uses include walls for buildings (both interior and exterior walls), trailers, railroad cars, and the like.

In view of the rapid growth of racquet sports such as racquetball and squash, a great deal of emphasis is being placed on the development of an economical and satisfactory wall system suitable for these sports. The major types of wall systems now in use fall into primary categories: plaster walls, where various types of plaster are applied over a masonry receiving surface, and panel walls, where wood based panels are applied over steel studs.

Plaster over masonry walls have proven unsatisfactory because of settlement and shrinkage cracks, high cost, surface condensation (sweating) during periods of high humidity, cutting of the plaster caused by racquet impacts on side walls, spalling on front impact walls caused by ball impact and suction as the ball leaves the wall, long drying times required after plaster application which delay the openings of the facilities, difficulty of obtaining adequate on-the-job quality control with reference to mix ratios and application techniques, and the great difficulty of getting paints or coatings to permanently bond to the plaster. As a result, plaster walls are costly to install and are very costly to maintain in good condition. Also, there is an appreciable amount of lost revenue resulting from shut downs required to make repairs.

Walls comprising wood based panels over steel studs have solved most of the problems associated with plaster systems by concealing settlement cracks, substantially reducing surface condensation, resisting cutting by racquets on side walls, easily withstanding spalling of front impact walls from shock and suction, requiring no drying time, requiring very little on-the-job quality control supervision, and having an excellent ability to hold paint surface coatings and coverings such as melamine. The problems which are normally related to the use of wood based panels stem from the fact that the panels absorb varying degrees of moisture, resulting in shrinkage and expansion forces within the panels. The forces generated by the changes in moisture content in the panels cause shrinkage cracks, warpage of the panels, and buckling of the panels, normally at the seams and particularly in vertical seams. Shrinkage cracks are unsightly, and warpage and buckling of the panels at the seams destroy the planarity of the panels and render the wall surfaces unsightly and unplayable.

Attempts have been made to minimize this inherent movement potential of wood based panels due to changes in moisture content by introducing air conditioning, by increasing court ventilation to approximately eight air changes per hour, by using panels which have an appreciably higher density at a much higher cost than those which are normally available, and by coating the panels with various thicknesses of melamine facing materials which also substantially increases cost. None of these approaches have proven entirely satisfactory in practice since inefficient air conditioning and ventilation in sports courts are the rule, rather than the exception. Also, the perspiration given off by active players serve to appreciably increase the relative humidity in the courts, a factor which contributes to the unwanted growth of the wood based panels. Frequently it is necessary to install the panels in the building before the air conditioning is turned on and when there are significant amounts of construction moisture still in the air. Lastly, air conditioning, ventilation, the use of high density wood based panels to retard the rate of moisture absorption rather than lower density panels (62 pcf rather than 45 pcf), and the use of expensive melamine surfacing materials on both the fronts and backs of panels all serve to very substantially increase the cost of construction and operation of the courts.

The present invention is based on the observation that the use of wood based panels has advantages which greatly outweigh the known disadvantages. The present invention directs itself to overcoming the lack of dimensional stability normally associated with wood based panels by controlling their normal shrinkage and growth characteristics in a positive and relatively inexpensive manner. Lower density panels (45 pcf) and paint finishes can be used in the wall system according to the present invention.

SUMMARY OF THE INVENTION

The present invention is directed to a wall system which comprises a plurality of panels comprised of material dimensionally reactive to moisture content changes, each panel having a rear face disposed in a common plane with the rear faces of the other panels; a plurality of substantially parallel support members more dimensionally stable in their longitudinal direction with respect to moisture induced dimensional changes than the panels in that longitudinal direction, the support members being substantially rigid in a plane perpendicular to the common plane, the support members being secured to associated panels; and means to restrain moisture induced movement of the panels in a direction generally parallel to the common plane and transverse to the longitudinal direction of the support members, the restraining means including a plurality of stress straps dimensionally inert with respect to environmental moisture changes, the stress straps being secured to associated panels and lying in a plane parallel to the common plane in such transverse direction and being located between the associated panels and the face of the support members and fasteners passing into the panels and through intersecting portions of the stress straps and the support members to securely interconnect the associated panels with the support members and stress straps.

It is an object of the present invention to provide a wall system comprised of panels made of materials dimensionally reactive to moisture content changes and constructed in a manner so as to control normal shrinkage and growth tendencies of the panels in a positive and relatively inexpensive manner. By attaining this object, it is now possible to use wood based panels with a normal density which permits the lowering of costs and greatly increases the availability of the panels. In addition, it is not necessary to apply melamine facing to the fronts and backs of the panel in an effort to minimize moisture travel into the panels which would otherwise cause warpage, growth and buckling. The elimination of this step further significantly reduces the cost of the panels. By spacing the restraint means in a predetermined manner throughout the body of each panel, internal panel stresses which develop as a function of changing moisture content and tend to cause movement can be distributed more uniformly within the body of the panel.

Other objects and advantages will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a front elevation view of a wall system in accordance with the present invention, a portion of the coating being broken away for purposes of illustration.

FIG. 2 is a sectional view taken along the line 2—2 in FIG. 1 but on an enlarged scale.

DESCRIPTION OF THE PREFERRED EMBODIMENT

Figure 3:
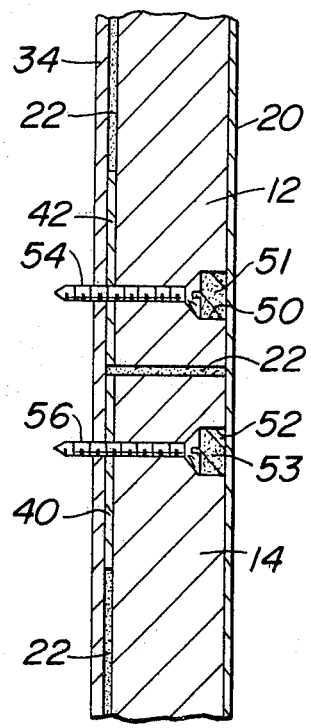
FIG. 3 is a sectional view taken along the line 3—3 in FIG. 1 but on an enlarged scale.

The panels are preferably secured to a plurality of parallel vertical steel studs having flanges bent at right angles to the webs of the steel studs so that the flanges are adjacent to the backs of the panels. Securing means such as self-tapping metal screws and structural adhesive preferably are used to secure the panels to the steel studs. This serves the dual function of securing the panels to the studs and limiting shrinkage or growth of the panels along the longitudinal axis of the steel studs, since the steel studs do not experience any shrinkage or expansion along their lengths as a function of environmental moisture change. A means is also provided to restrain shrinkage and growth of the panels in a direction perpendicular to the longitudinal axes of the steel studs and within the plane of the panels. It is in this direction in the plane of the face of the panels that movement forces induced by changes in moisture content of the panels are nearly always the most pronounced. The means to provide shrinkage and growth restraint perpendicular to the longitudinal axes of the studs in the plane of the panels includes a plurality of parallel steel stress straps secured to a rear face of each panel. Each strap is in intersecting relation with the flanges of the steel studs adjacent to the panel.

Self-tapping metal sheet screw fasteners preferably are seated in counterbored holes drilled through the face of the panels in a predetermined manner to distribute desired restraint forces throughout the panel. Fasteners fit snugly in these pre-drilled holes and pass through an intersecting portion of a stress strap and a flange of a steel stud. The fasteners securely interconnect each panel with the flanges of the steel studs and stress straps associated therewith. A filler means is applied over the fasteners in the holes to fill the holes flush with the front face of each panel. A finish coating is then applied to the face of the panel, covering the exposed surface of the filler means.

Referring to the drawings in detail, wherein like numerals indicate like elements, there is shown in FIG. 1 a wall system designated generally as 10. Wall system 10 is comprised of a plurality of panels 12, 14, 16 and 18, each having a front face lying in a common plane. While the wall system shown in FIG. 1 is comprised of only four panels, a typical wall will have a larger number of panels. The panels may be of any desired dimension, for example, as small as 4′×4′ to as large as 5′×10′. The presently preferred dimension of the panels is 5′×8′. Each of the panels is made of conventional binders and material dimensionally reactive to moisture content changes. This material may be agricultural materials such as bagasse or other compressed cellulosic materials, and is preferably a wood based material such as particleboard, fiberboard, hardboard, plywood or the like. The thickness of the panels normally varies from about ¾ inch to about 1 inch with the 1 inch thickness being preferred.

The wall system 10 has a wear coating 20 applied to the front face. In FIG. 1, coating 20 is illustrated as applied only to the upper right edge of the figure for purposes of illustration. Panels 12, 14, 16 and 18 need not but may be interconnected along their peripheral edges by a tongue and groove construction, by a spline interconnected into two grooves in adjacent panels, by an adhesive bonding agent 22 which joins the side faces of the juxtaposed panels, or by any combination thereof. Bonding adhesive 22 may be any one of a wide variety of materials used for adhesive bonding, and the preferred material for bonding adhesive 22 is PL 400, a rubber base adhesive manufactured by B.F. Goodrich Co.

Each panel is secured to a plurality of support members. The support members may be made of any material which is relatively dimensionally inert or stable with respect to environmental moisture changes in the longitudinal direction in comparison with the potential movement of the panel in the same direction as a result of moisture content changes. Wood support members have a coefficient of linear expansion along their longitudinal axes of only about 10 to 20% of the coefficient of linear expansion of panel members made of particleboard or fiberboard as used in a preferred embodiment. In the presently preferred embodiment, the support members are made of steel, since steel is dimensionally unaffected by changes in environmental moisture content. The support members are rigid in a plane perpendicular to the plane of the panels to resist force applied to the face of the panels and forces generated within the panels in that direction.

Figure 4:
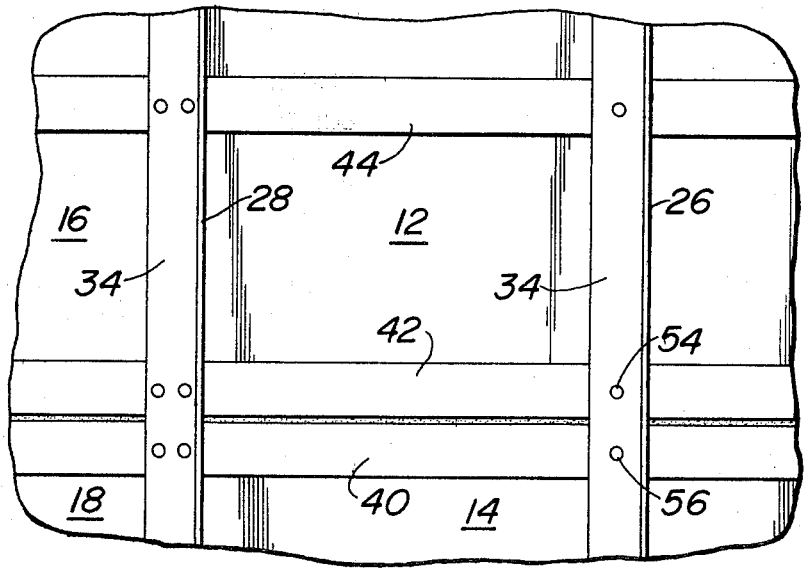
FIG. 4 is a portion of a rear elevational view of the wall system shown in FIG. 1.

Referring to FIGS. 1, 2, and 4, each support member 24, 26 and 28 in the form of steel studs has a flange or face 34 fixedly secured to the rear face of panel 14. The studs are shown as L-shaped in cross-section as in FIG. 2 for purposes of illustration, but preferably are C-shaped in cross-section. The studs are securely attached at their base to a foundation. The flanges 34 are preferably secured to the juxtaposed rear face of the panels by bonding adhesive 22 which serves the dual function of securing the panels to the studs between stress straps 42 and 44 and filling the void which would otherwise exist between the backs of the panels and the outer face of the flange 34 caused by the thickness of the stress straps. Since the studs are longer than the height of the panels, two or more panels may be connected to the same stud. Adhesive 22 is normally applied by a cartridge gun in a bead along the flange of the steel studs, and is compressed in its uncured condition to a thickness of about 0.020 inch when the panel is secured to the steel stud flange.

Stress straps, made from a material which does not shrink or expand from varying degrees of environmental moisture and which has a high degree of resistance to tearing where the securing screws pass through it, are applied parallel to one another and perpendicular to the longitudinal axis of the steel support members against the rear face of the panels. Steel is the presently preferred material because it has these characteristics and is relatively inexpensive. It is preferable to secure the stress straps to the back of the panels with a bonding adhesive such as bonding adhesive 22. Adhesive bonding of the stress straps to the panel is preferred when the thickness of the stress straps is such that without this adhesive bonding support to hold it planar in times of stress, it would buckle away from the back of the panel in the event that the panel should try to shrink once the securing screws are in place. When the thickness of the stress straps is 0.020 inch, it is desirable to adhesively bond the stress straps to the rear face of the panel with a bonding adhesive such as B.F. Goodrich Co.'s PL 400 in order to control deformation of a buckling nature from shrinkage forces generated within the panel and to control non-planarity of the stress straps so that no unrestrained movement can occur if tension should be exerted on the stress straps by expansion forces generated within the panel. In addition, the restraint force of the stress straps is increased by applying adhesive along the length of the stress straps to bond the stress straps to the panel and by applying adhesive between the stress straps and support members.

Referring to FIGS. 3 and 4, parallel stress straps 40, 42 and 44 are illustrated. The stress straps may be of any conventional economical dimensions so long as they have the characteristics discussed herein. Steel stress straps having a thickness of about 0.015–0.060 inch and width of about 0.5 to about 4 inches are suitable. The stress straps may be longer than the horizontal width of one panel, so that two or more panels can be secured to one length of the stress straps. The preferred thickness of the parallel stress straps is 0.020 inch, and the stress straps are preferably long enough to correspond with the horizontal width of the panel. The preferred width for the stress straps located along the edges of the panels is 1–½ inches, and for the stress straps located near the center of the panel is 3 inches. Straps 40 and 42 are secured to the rear face of panels 14 and 12, respectively, adjacent the joint between the panels. Strap 44 lies between the horizontal edges of the panel 12. Preferably, three stress straps are used per panel, but more may be used in combination with more securing screws if it is desired to increase the mechanical stress restraint within the panel. The flange 24 of the steel studs intersects each of the steel stress straps and generally is perpendicular thereto.

As shown more clearly in FIG. 3, holes are drilled through the panels and counterbored as shown at 50 and 52. Fasteners 54 and 56 securely interconnect the panels and the intersecting portions of stress straps 40 and 42 and flange 34. The diameter of the shank of fasteners 54 and 56 (about 9/64 inch) should very closely correspond to the diameter of the holes drilled through the rear portions of the panels to limit any lateral movement of the panel independently of the securing screws. Alternately, the fasteners can pass through the support member flange, the stress straps and into the rear face of the panels. This has the advantage of eliminating the necessity of drilling holes in the panel from the front face. Preferably, securing screws 54 and 56 are self-tapping sheet metal screws with a length of 1 ½ inches. Holes 50 and 52 are thereafter filled with a filler material 51 and 53, respectively, which will fill the hole flush with the face of the panel. The filler material should be sanded smooth, and should have a high degree of tenacity to withstand coming out of the hole during use of the wall. A satisfactory material is Durabond 90, a fill compound manufactured by U.S. Gypsum Co. Filler material 51 and 53 is completely concealed by the wear coating 20. Coating 20 may be a conventional paint such as semi-gloss enamel, but preferably it is a two-component polyester finish such as semi-gloss Pittglaze manufactured by Pittsburgh Paint and Glass Co.

Wood based panels have a tendency to shrink and to grow more or less equally in all directions because of the random orientation of the wood particles within the panels. To calculate the restraining force necessary per square foot of panel to prevent movement, it is first necessary to decide through what range of moisture content of the panels one wishes to restrain movement, and then to calculate what approximate forces will be generated within the panels within that selected range of moisture content. In the case of wall surfaces comprised of wood based panels used in racquetball courts indoors, it has been found that the normal variation in moisture content is between 7% during dry winter months and about 11% during warmer and more humid summer months. Panels are manufactured at a moisture content of between 6–8%, and should be installed at a moisture content of 9%. Since growth and shrinkage forces are also more or less equal in wood based panels, the restraint designed into the wall system should provide for a ±2% moisture content change in the panels.

The formula for determining stress in a particleboard panel is as follows: STRESS = Coefficient of linear expansion of the panel for each 1 percent of moisture content change × the percent change in moisture content for which one is designing × the modulus of elasticity of the panel divided by the "relaxation factor" of the panel. All of the above values are relatively well defined for any given panel with the exception of the "relaxation factor". The "relaxation factor" is an experimentally determined allowance factor for stress reduction caused by plastic flow of the visco-elastic panel material itself at sustained increased pressure levels. This factor can be relatively low, such as 2 if the moisture content change occurs rapidly (such as within 24 hours), and might normally be expected to have a value as high as 4 if the change occurs slowly over several weeks as from a change in relative humidity slowly penetrating the panel front and back faces through multiple protective paint coatings (as in the case in the preferred embodiment of this invention).

The coefficient of linear expansion for each one percent of moisture change for a preferred panel is 0.0003723. The plus or minus anticipated change in moisture content of the panel for which restraint is desired = 2.0. The modulus of elasticity of a preferred panel is approximately 400,000 psi. The relaxation factor to be used in anticipation of slow moisture absorption into the panel = 4.0. Therefore, the stress equation for the preferred embodiment is as follows: STRESS = 0.0003723 × 2.0 × 400,000 ÷ 4.0 = 74.5 pounds per square inch of vertical edge area. Assuming a panel thickness of 1 inch, the approximate horizontal growth or shrinkage force per vertical foot of panel edge generated within the panel in a direction parallel to the face of the panel would = stress × edge area/vertical ft. of panel edge = 74.5 pounds per square inch × 1" × 12" = 894 pounds per vertical foot of panel edge.

The restraint force which can be exerted by the stress straps is a function of the yield stress of material used in the stress straps, the thickness of the stress straps, the width of the stress straps, the diameter of the fastener going through the stress straps, the adhesive bond restraint generated by the adhesive bonding the stress straps to the panels and the supporting members, and the compressive force exerted by the fasteners in securing the stress straps between the panels and the support members.

In the preferred embodiment set forth hereinbefore, the maximum horizontal restraint force which can be provided by steel stress straps 3 inches wide × 0.020 inch thick with an allowable yield stress of 30,000 psi (the allowable yield stress includes a design safety factor of approximately 2.43) can be determined as follows:

$F_{(max)}$ = stress$_{(allow.)}$ × cross-sectional area × safety factor = 30,000 psi × 3" × 0.020" × 2.43 = 4374 pounds per stress strap.

Since the spacing of the stress straps in the preferred embodiment is 2.5 feet on center vertically, the maximum horizontal restraint force which can be exerted by the stress strap per vertical foot of panel edge = $F_{(max)}$ ÷ 2.5 feet = 1750 pounds per vertical foot of panel.

If no adhesive is applied to the stress strap and no compressive force is exerted on the stress strap by the rear face of the panel or the front face of the vertical support member as the screws are tightened, then the maximum horizontal restraint force in tension which the stress strap can generate, assuming that the diameter of the screws is 0.140 inch and the thickness of the stress strap is 0.020 inch, is defined by the formula:

$F_{(restraint)}$ = 0.140" × 0.020" × 30,000 psi × 2.43 = 204 pounds per stress strap per set of opposing screws.

The actual horizontal restraint force of the stress straps applied in accordance with the present invention lies between these values. In the presently preferred embodiment, three stress straps spaced 30 inches on center vertically are adhesively and mechanically secured to each panel and to vertical support members spaced 12 inches on center. The cumulative horizontal restraint force exerted by the stress straps must be equal to the moisture induced growth or shrinkage forces generated by the panel horizontally to control panel growth.

Factors entering into providing the desired degree of restraint include: the spacing of the steel support studs (12 inches on center in the preferred embodiment); the gauge and depth of the steel support studs (0.040 inch thick with a 6 inch web in the preferred embodiment); the gauge and spacing of the steel stress straps (0.020 inch thick × 3 inches wide × 96 inches long spaced 30 inches on center vertically in the preferred embodiment); the staggering of the panels from row to row (vertical joints are spaced 50% from row to row in the preferred embodiment); gluing and splining horizontal joints together (this is done in the preferred embodiment); coating both rear and front faces of panels with multiple coats of moisture impeding finish to substantially slow down any transfer of moisture either into or out of the panels (this is done with three coats of lacquer on the rear faces of the panels and with two costs of polyester epoxy on the front faces of the panels in the preferred embodiment); the number and diameter of screws or fasteners used to secure the panels on the steel support studs and to simultaneously penetrate the steel stress straps (approximately one screw having a diameter of 0.140 inch per 1.5 square feet of panel area is used in the preferred embodiment); the location of vertical edges of panels over a common steel stud flange so that the securing screws on both sides of the edges going through the steel stress straps and on the common flange of the steel stud will form a continuous stress restraint (this is done in the preferred embodiment); and the securing of the panels with structural adhesive to each other, to the steel stress straps and to the steel support studs (This is done in the preferred embodiment using continuous adhesive which also bonds the outer face of the steel stress straps to the face of the steel stud flanges. The adhesive of choice is PL 400 manufactured by B.F. Goodrich Co.).

A number of prototype courts designed as above with only minor variations have demonstrated that the restraint forces imposed by the present invention are greater than the potential movement forces generated by varying moisture content within the panels within the 7 to 11% moisture content range. This was demonstrated by measuring the moisture content of the panels in the winter (and getting readings of approximately 7%) and by measuring the moisture content of the panels in summer months (and getting moisture content readings as high as 11%). Throughout this change of moisture content, seams of panels (both vertical and horizontal seams) remained almost invisible to the eye once coated with a two-component polyester epoxy finish (two coats of Pittglaze epoxy finish manufactued by Pittsburgh Paint and Glass Co. were used).

Because of the very complex interrelationship of the restraining factors and of the forces actually generated by the panels, a precise definition of forces generated cannot be made. The restraint force provided by the present invention exceeded growth and shrinkage forces of the panels. Also, other walls constructed similarly, but without stress straps, all showed movement in the seams.

Steel support studs are inert to dimensional change in length as a function of changing conditions of relative humidity and may therefore be relied on to exert a positive vertical restraining force on any vertical growth or shrinkage forces exerted within wood based panels attached to the steel studs, provided that the panels are securely attached to the steel studs. Steel studs erected with their webs transverse to the plane of the panels have much less restraint to bending in the plane of the panels and transverse to the longitudinal axes of the studs than they do in a direction transverse to the plane of the panels, and for this reason it is necessary to provide additional horizontal restraint (in the form of stress straps according to this invention) if it is desired to contain moisture induced growth and shrinkage forces of the panels in this direction. The use of steel stress straps as above described provides this necessary restraint. In order for the panels to grow or shrink along the longitudinal axes of the steel studs, it would be necessary for the steel studs to also change in length or for the fasteners to shear off or tear the stud flange, and for the structural adhesive bond to fail. This would require a force in excess of that generated by the panel going through a moisture content change of two percent. In the horizontal direction, growth or shrinkage can only occur if the adhesive bond between the panels and the stress straps fails, if the adhesive bond between the stress strap and the stud flange fails, if the screws used to interlock the panels, the stud flanges and the steel stress straps fail either in shear or by tearing the steel stress along its length, if the panel fails around the screw, or if the stress strap snaps. Again, experience has shown that the forces generated by the panels in the test situation did not exert forces of this magnitude, either in shrinkage or in growth.

A completed wall system in accordance with the present invention, after application of coating 20, is relatively seamless in appearance and moisture induced growth and shrinkage forces are controlled throghout the moisture ranges for which the wall system is designed. By maintaining a flat and essentially seamless condition, warpage, joint buckling, objectionable shrinkage cracks and other defects are overcome. The wall system of the present invention may be upright, angled, or part of a horizontal surface such as a ceiling or floor. Depending upon the desired safety factor on the restraining force versus shrinkage and growth forces, a number of factors involved may be varied as desired. Some of the factors which may be varied are panel thickness, size, and properties; number and type of fasteners and their diameter; spacing and gauge of both studs and stress straps; etc. As an example, wall stiffness can be doubled by locating steel studs 6 inches on center versus 12 inches on center without affecting the basic horizontal growth and shrinkage restraint force of the wall if the panels are adhered to the intermediate studs with structural adhesive, but are not interconnected by screws through the stress straps, the panels and the flanges of the intermediate steel studs.

It wll be noted that in a wall system in accordance with the present invention, the stress restraint is relatively balanced and distributed throughout the panels to avoid a stress buildup and resultant strain and deformation within the body of the panel and at vertical and horizontal panel joints. This avoids the failure normally observed with wood based panels attached to steel support studs, namely a shrinkage or growth and buckling at vertical seams resulting from changes in moisture content within the panels.

The present invention may be embodied in other specific forms without departing from the spirit or essential attributes thereof and, accordingly, reference should be made to the appended claims, rather than to the foregoing specification, as indicating the scope of the invention.

I claim:

1. A restricted growth or shrinkage sports court wall system comprising:

(a) a plurality of panels comprised of wood based material dimensionally reactive to moisture content changes, each panel having a rear face disposed in a common plane with the rear faces of the other panels, (b) a plurality of substantially parallel support members more dimensionally stable in their longitudinal direction with respect to moisture induced dimensional changes than said panels in said longitudinal direction, said support members being substantially rigid in a plane perpendicular to said common plane, said support members being secured to associated panels, and (c) means to restrain moisture induced movement of said panels in a direction generally parallel to said common plane and transverse to said longitudinal direction, said restraning means including a plurality of flat stress straps dimensionally inert with respect to environmental moisture changes, said stress straps being secured to associated panels in a plane parallel to said common plane in said transverse direction and being located between said associated panels and said support members, and fasteners passing into said panels and through intersecting portions of said stress straps and said support members.

2. A wall system in accordance with claim 1 wherein said faces of said support members are further secured to said rear face of each panel and said stress straps by an adhesive.

3. A wall system in accordance with claim 1 wherein said stress straps are steel bands having a thickness of about 0.015 to about 0.060 inch and a width of about 0.5 to about 4 inches, said stress straps having a length corresponding to the transverse dimension of their associated panels.

4. A wall system in accordance with claim 1 wherein said stress straps are steel bands having a length greater than the transverse dimension of their associated panel.

5. A wall system in accordance with claim 1 wherein said fasteners are disposed throughout a panel so as to distribute restraint forces throughout said panel.

6. A wall system in accordance with claim 1 wherein each of said panels has an area in said common plane of about 16 to about 50 square feet.

7. A wall system in accordance with claim 1 wherein each of said panels has a front face disposed in a common plane with the front faces of the other panels.

8. A wall system in accordance with claim 1 wherein said stress straps are adhesively bonded along their length to said rear face of each associated panel.

9. A wall system in accordance with claim 1 wherein said panels are made of wood based material selected from the group consisting of particleboard, fiberboard, hardboard and plywood.

10. A wall system in accordance with claim 1 wherein at least some edges of adjacent panels are secured together by adhesive and splines.

11. A wall system in accordance with claim 1 wherein said panels have a thickness of about $\frac{3}{4}$ inch to about 1 inch.

12. A restricted growth or shrinkage sports court wall system comprising:

(a) a plurality of wood based panels, each panel having a rear face disposed in a common plane with the rear face of the other panels, (b) a plurality of substantially parallel steel support members being substantially rigid in a plane perpendicular to said common plane, said support members being secured to associated panels, (c) means to restrain moisture induced movement of said panels in a direction generally parallel to said common plane and tranverse to the longitudinal axes of said support members, said restraining means including a plurality of flat steel stress straps secured against the rear faces of associated panels in said transverse direction and being located between said panels and said support members, and fasteners passing into said panels and through intersecting portions of said stress straps and said support members to securely interconnect said associated panels with said support members and said stress straps, (d) said support members being secured to said associated panels between adjacent stress straps by an adhesive, (e) said support members being secured to said stress straps by an adhesive, and (f) said support members being longer than said associated panels in a direction along the longitudinal axes of said support members so that two or more adjacent panels are each joined to the same support member.

* * * * *